US007654796B2

(12) United States Patent
Yeh et al.

(10) Patent No.: US 7,654,796 B2
(45) Date of Patent: Feb. 2, 2010

(54) ELECTRIC FAN WITH BEARING

(75) Inventors: Chin-Wen Yeh, Tu-Cheng (TW); Chin-Long Ku, Tu-Cheng (TW); Hsieh-Kun Lee, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 570 days.

(21) Appl. No.: 11/309,368

(22) Filed: Aug. 1, 2006

(65) Prior Publication Data

US 2008/0031737 A1 Feb. 7, 2008

(51) Int. Cl.
*F04D 29/056* (2006.01)

(52) U.S. Cl. ..... 416/174; 415/229; 417/423.12; 310/90

(58) Field of Classification Search ..... 416/174; 415/229
See application file for complete search history.

(56) References Cited

U.S. PATENT DOCUMENTS 4,553,857 A 11/1985 Ney
6,010,318 A 1/2000 Li
6,254,348 B1 7/2001 Lee

FOREIGN PATENT DOCUMENTS

| | | | |
|---|---|---|---|
| CN | 2545404 | | 4/2003 |
| CN | 2545404 Y | * | 4/2003 |
| CN | 1727693 | | 2/2006 |
| WO | 2005/057033 A1 | | 6/2005 |

* cited by examiner

*Primary Examiner*—Richard Edgar
(74) *Attorney, Agent, or Firm*—Frank R. Niranjan

(57) ABSTRACT

An electric fan includes a fan base (10), a bearing (40) and a rotor assembly (20). The fan base forms a central tube (11) receiving the bearing therein. The rotor assembly includes a fan hub (22), and a pivot axle (23) joined to the fan hub. The pivot axle pivotably extends into the bearing. The bearing has an outer wall (41) with a plurality of bulwarks (45) circumferentially formed thereon. At least one partition hole (424, 43*a*) corresponding to the bulwarks is defined in the bearing. The at least one partition hole effectively prevents a radially inward pressure exerted by the central tube on the bearing from being exerted to the pivot axle via the bearing. Therefore, a friction between the bearing and the pivot axle is reduced.

11 Claims, 10 Drawing Sheets

ELECTRIC FAN WITH BEARING

FIELD OF THE INVENTION

The present invention relates generally to an electric fan and more particularly to an electric fan with a low friction bearing.

DESCRIPTION OF RELATED ART

As ICs (Integrated Circuits) such as computer CPUs (Central Processing Units) are being designed to run faster and faster, more and more heat is being generated by these ICs. Electric fans are typically used to dissipate the heat generated by these ICs.

Referring to FIG. 10, an electric fan 90 in accordance with related art includes a stator assembly and a rotor assembly pivotable with respect to the stator assembly. A bearing 92 is secured within a sleeve 94 of the stator assembly and is used to pivotably support a pivot axle 98 of the rotor assembly. An inner surface of the bearing 92 engages with the pivot axle 98. An outer surface of the bearing 92 engages with the sleeve 94. When the fan 90 operates, the bearing 92 is radially pressed by the sleeve 94; thus, a large-area friction exists between the pivot axle 98 and the inner surface bearing 92. This results in that the bearing 92 is quickly worn away to thereby reduce the lifespan of the bearing 92 and generate undesired noise.

SUMMARY OF THE INVENTION

According to one embodiment, an electric fan includes a fan base, a bearing and a rotor assembly. The fan base forms a central tube receiving the bearing therein. The rotor assembly includes a fan hub, and a pivot axle joined to the fan hub. The pivot axle pivotably extends into a hole of the bearing. The bearing has an outer wall with a plurality of bulwarks circumferentially formed thereon. At least one partition hole corresponding to the bulwarks is defined by the hole of the bearing. The at least one partition hole has a diameter larger than that of the pivot axle. The central tube engages with the bearing at the bulwarks. The at least one partition hole effectively prevents a radially inward pressure exerted by the central tube on the bearing from being exerted to the pivot axle via the bearing, whereby a friction between the bearing and the pivot axle is reduced.

Other advantages and novel features of the present invention will become more apparent from the following detailed description of preferred embodiment when taken in conjunction with the accompanying drawings, in which:

DETAILED DESCRIPTION OF THE INVENTION

Figure 1:
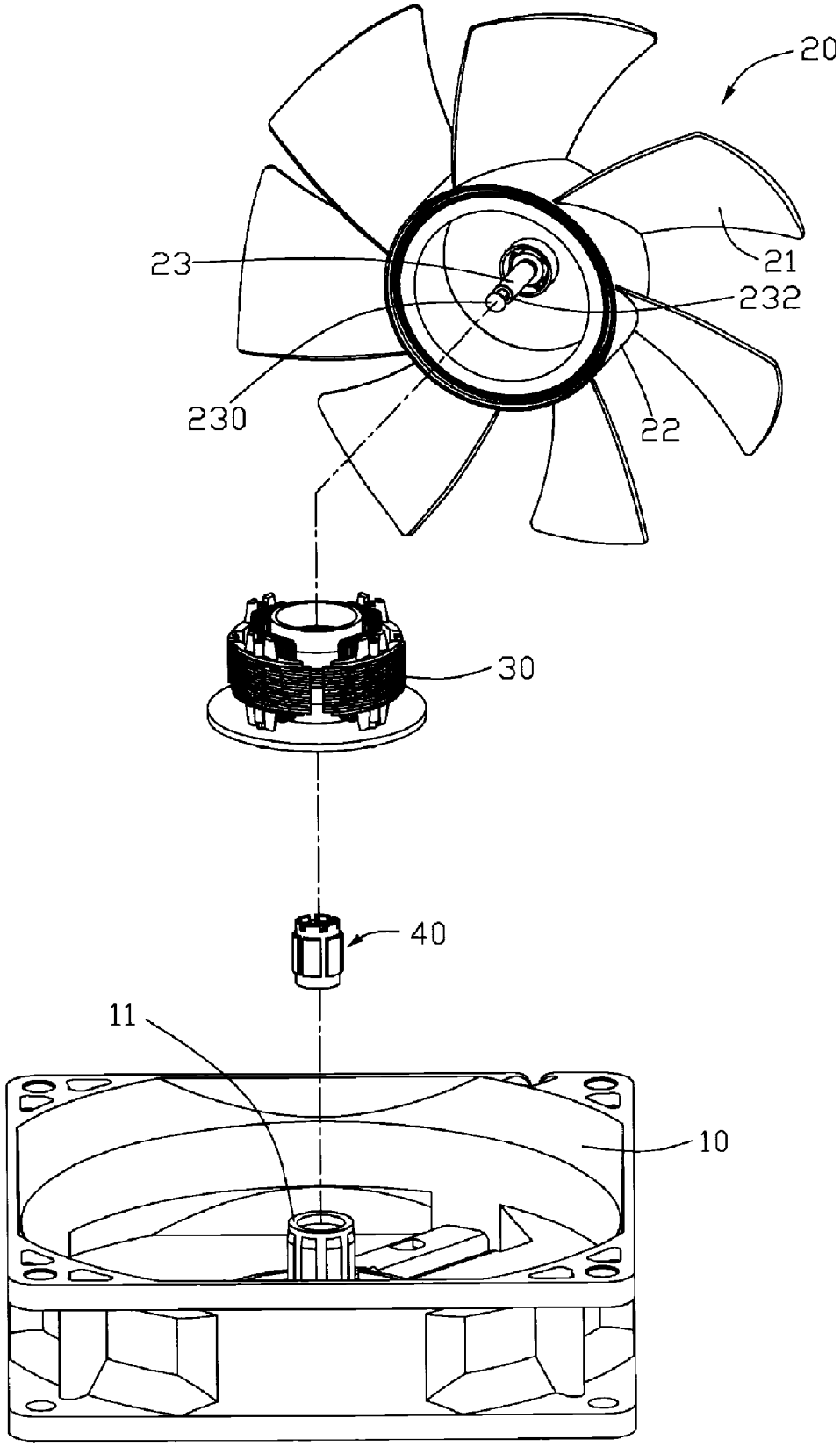
FIG. 1 is an exploded, isometric view of an electric fan in accordance with a preferred embodiment of the present invention.

FIG. 1 illustrates by way of example an electric fan in accordance with a preferred embodiment of the present invention. The fan comprises a fan base 10, a rotor assembly 20, a stator assembly 30 and a bearing 40. The rotor assembly 20 is pivotable with respect to the stator assembly 30.

Figure 4:
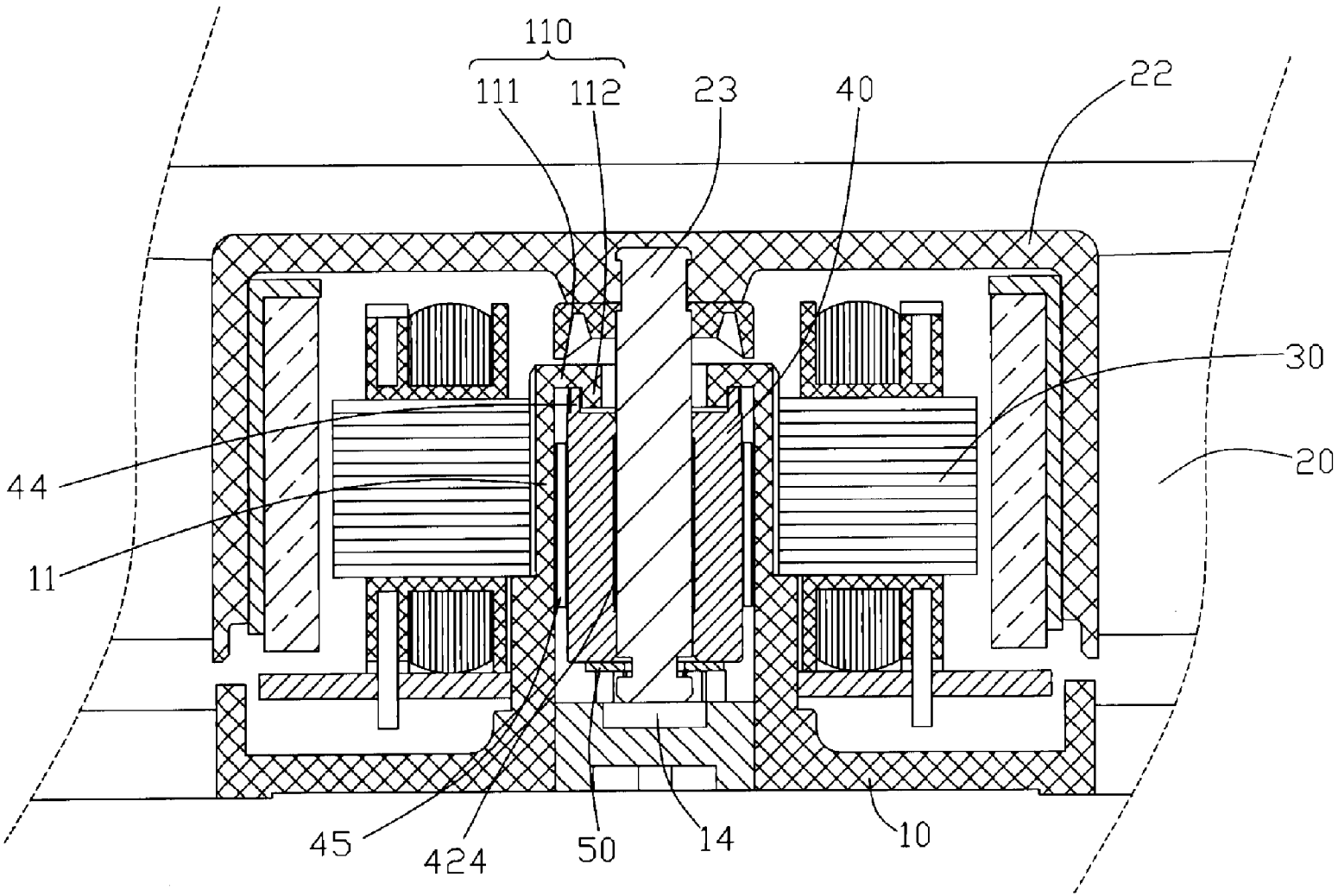
FIG. 4 is an assembled, cross-sectional view of the electric fan of FIG. 1.
Figure 5:
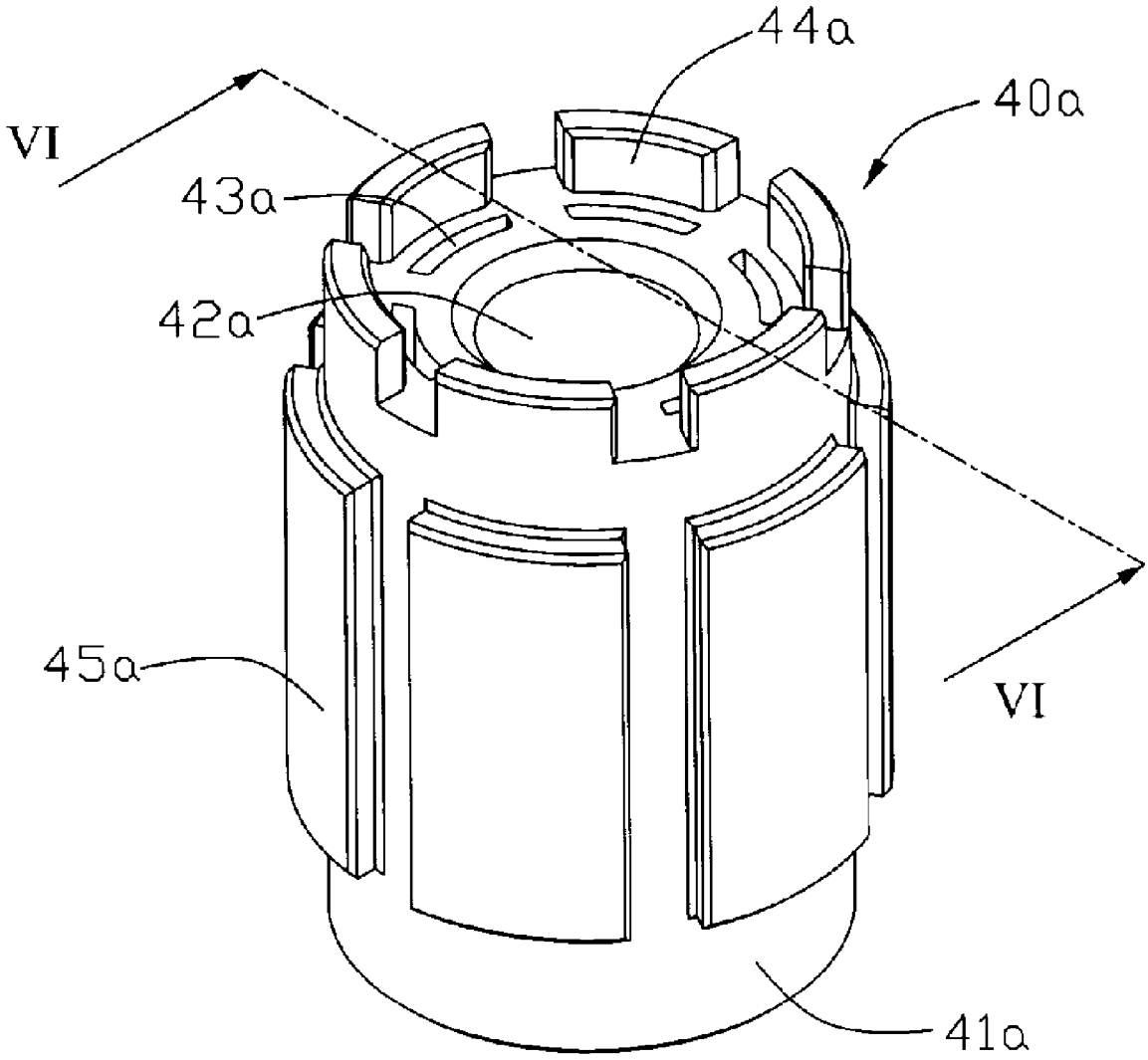
FIG. 5 is an isometric view of a bearing in accordance with a second embodiment of the present invention.
Figure 6:
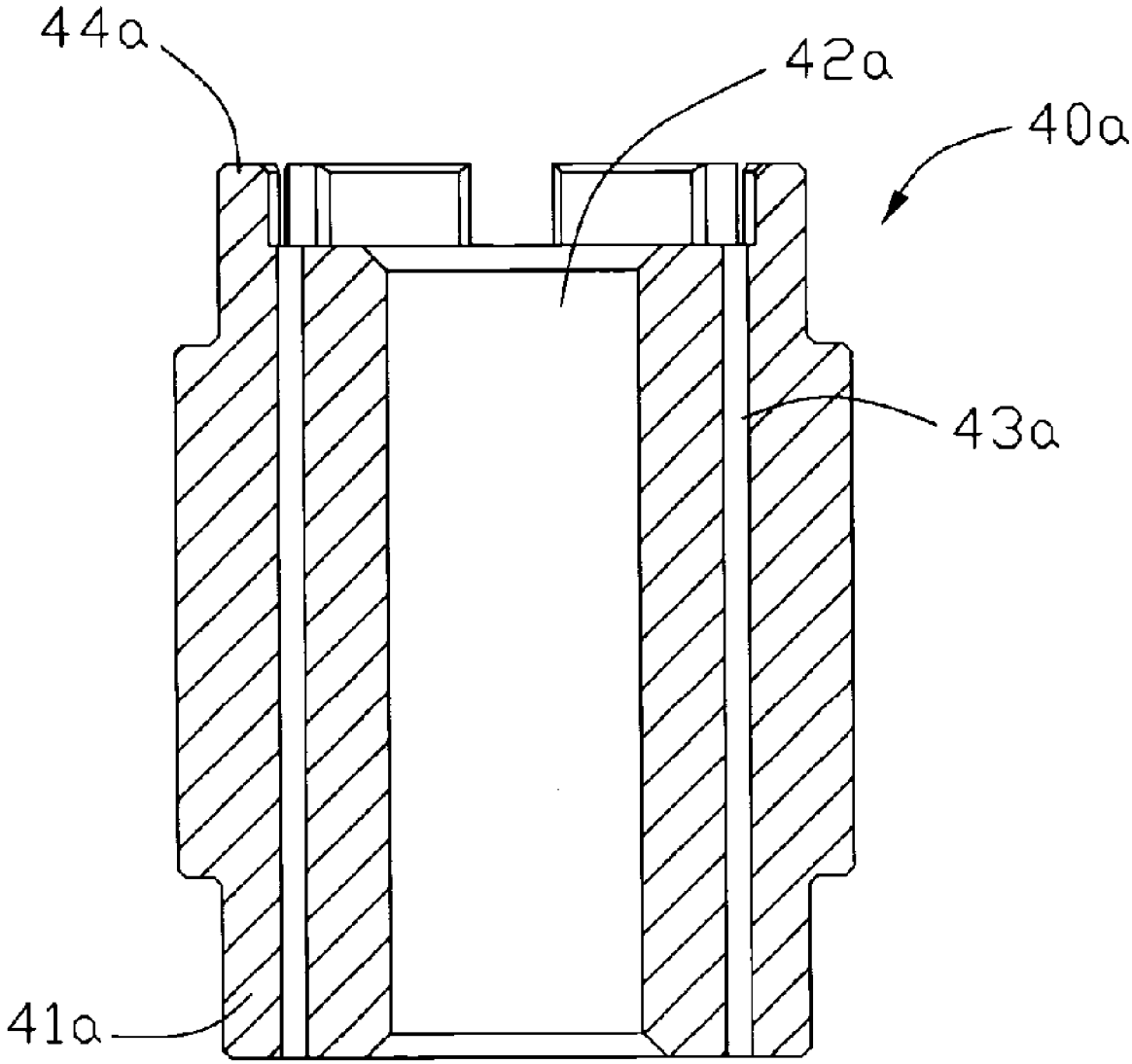
FIG. 6 is a cross-sectional view taken along line VI-VI of FIG. 5.
Figure 7:
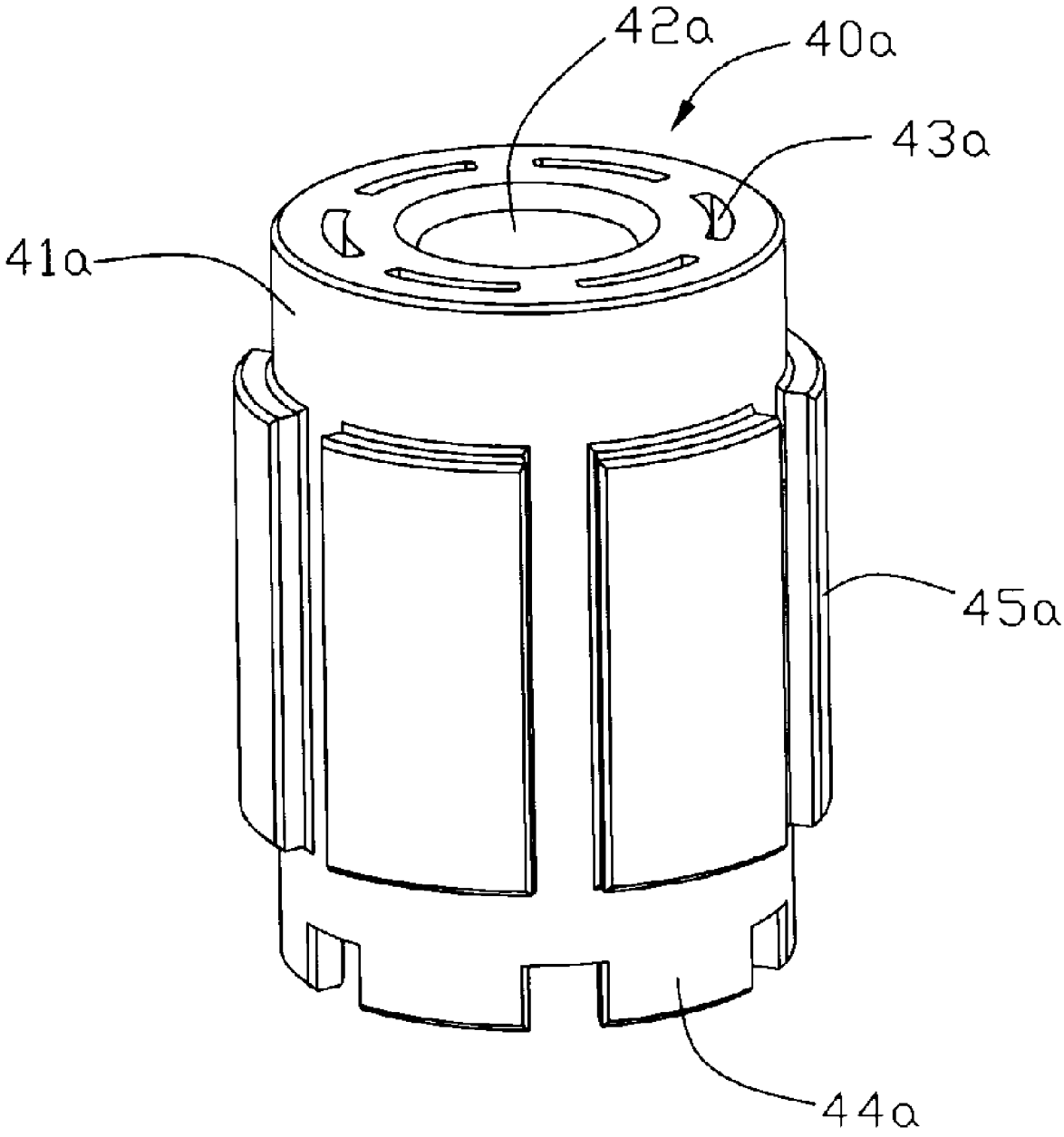
FIG. 7 is a view similar to FIG. 5, but shown from an opposite bottom aspect.
Figure 8:
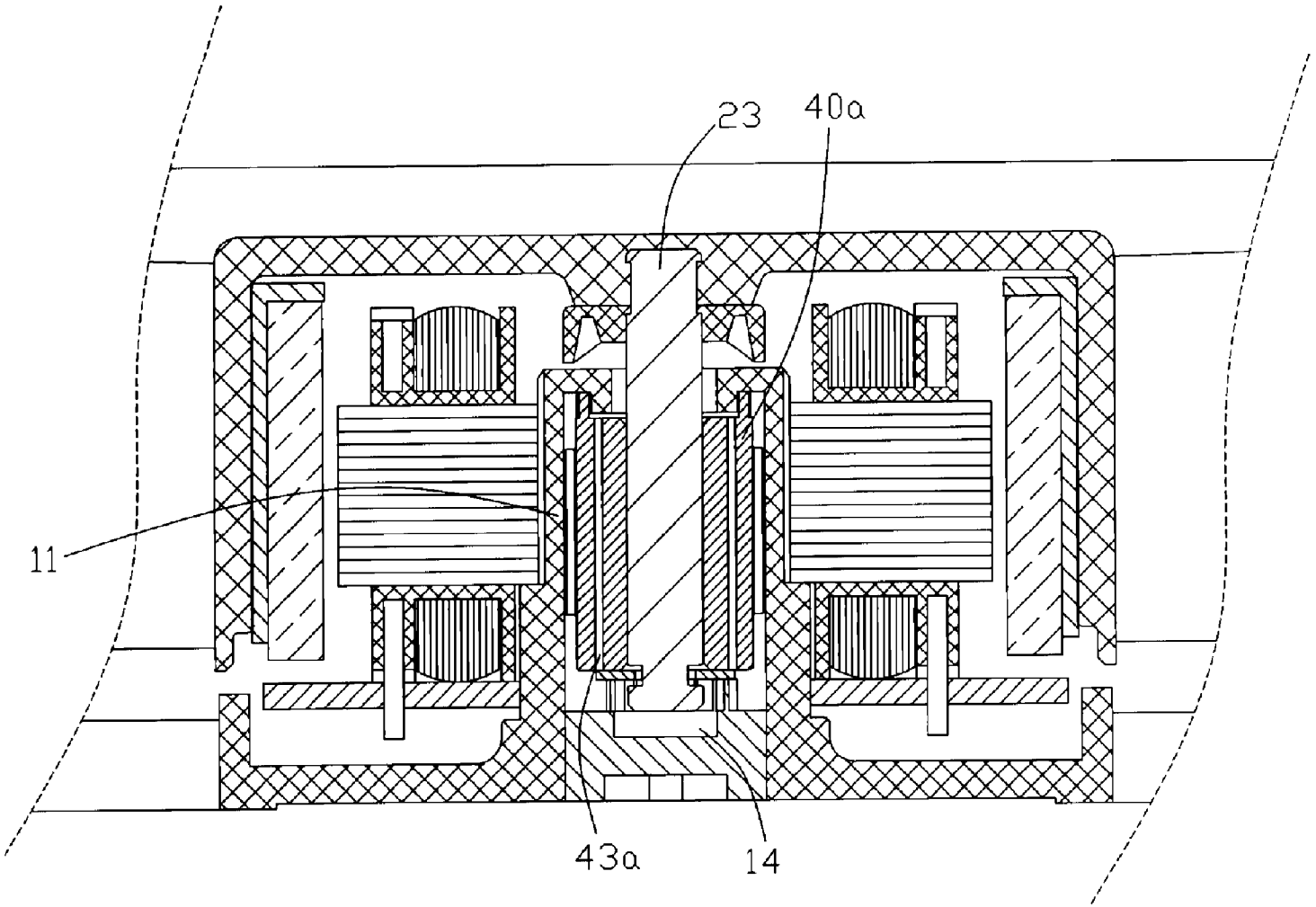
FIG. 8 is an assembled, cross-sectional view of an electric fan incorporating the bearing of in accordance with the second embodiment of the present invention.

The fan base 10 defines a cavity (not labeled) therein for receiving the rotor assembly 20 and the stator assembly 30 therein. A central tube 11 is formed at a central portion of the fan base 10. The central tube 11 has a hollow and cylindrical configuration. Referring also to FIG. 4, the bearing 40 is engagingly received in the central tube 11. The stator assembly 30 is attached around the central tube 11. A baffle element 110 bends inwardly from a top of a circumferential wall (not labeled) of the central tube 11 and engages with the bearing 40 so as to prevent lubricating oil from leaking from a top end of the bearing 40. The baffle element 110 comprises an annular connecting portion 111 extending perpendicularly, horizontally and inwardly from the top of the circumferential wall of the central tube 11 and a leg 112 extending perpendicularly and downwardly from an inner end of the connecting portion 111. A lubricant reservoir 14 is formed in the fan base 10 below the bearing 40, which supplies lubricant oil as the fan is operated.

The rotor assembly 20 comprises a generally cup-like fan hub 22 having a top wall (not labeled) and a periphery wall (not labeled). A plurality of fan blades 21 are formed around the periphery wall of the fan hub 22. A pivot axle 23 extends perpendicularly downwards from the top wall of the fan hub 22. A semispherical-shaped guiding portion 230 is formed at a distal, bottom end of the pivot axle 23. An annular slot 232 is defined adjacently above the guiding portion 230 for receiving a ring 50 (shown in FIG. 4) which holds the rotor assembly 20 on the fan base 10.

Figure 2:
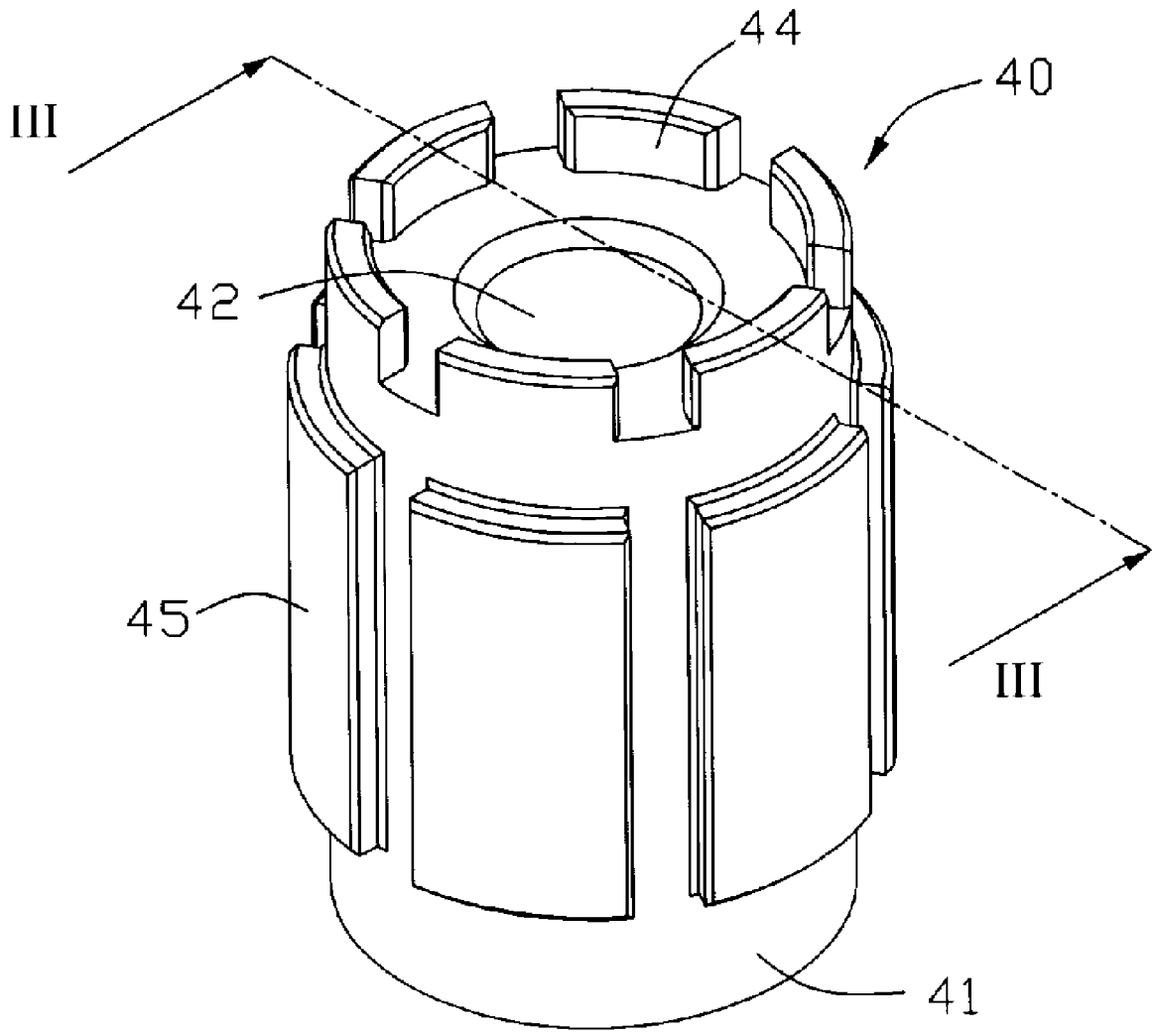
FIG. 2 is an isometric view of a bearing of the electric fan of FIG. 1.
Figure 3:
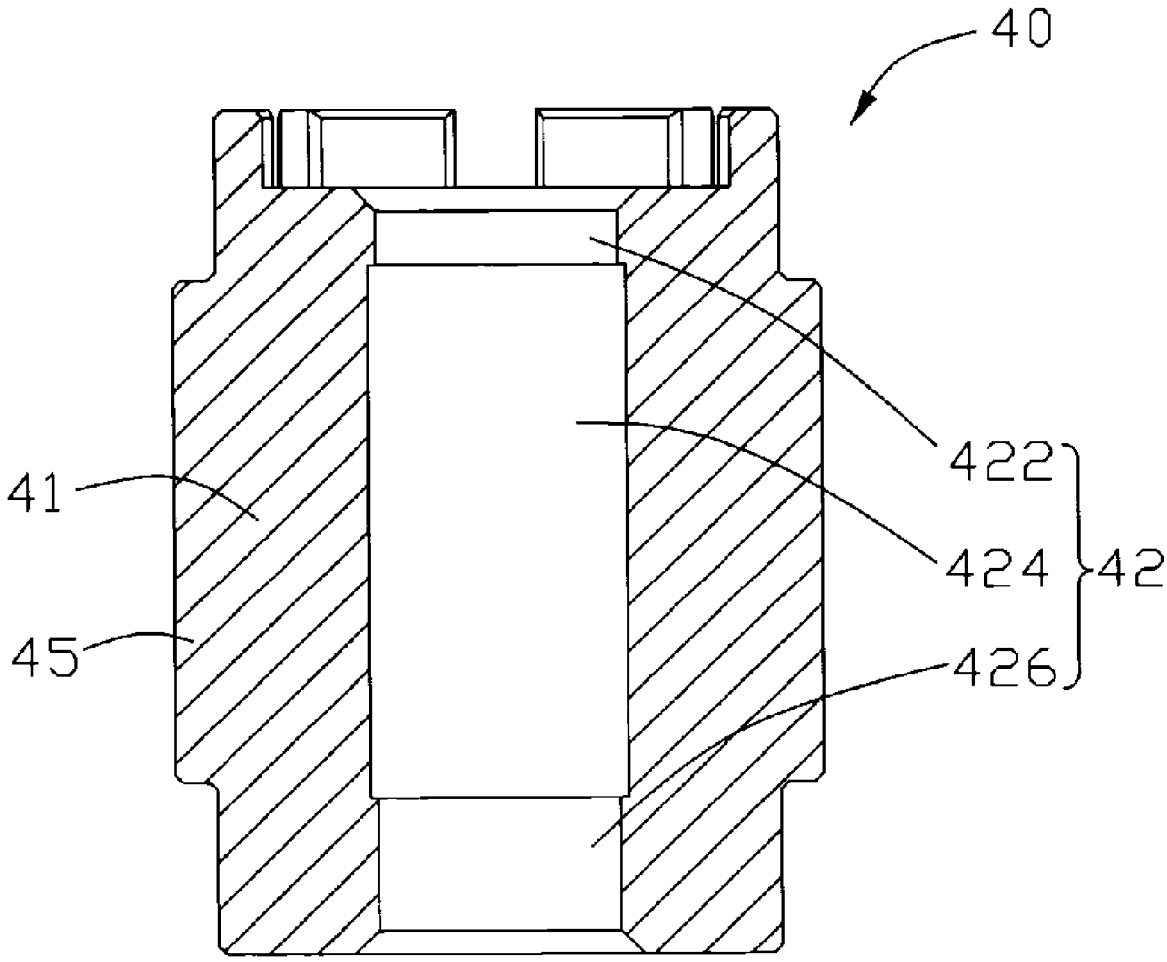
FIG. 3 is a cross-sectional view taken along line III-III of FIG. 2.

Referring to FIGS. 2-3, the bearing 40 has a cylindrical shape with a circumferential outer wall 41. A central hole 42 is defined in a central portion of the bearing 40 for receiving the pivot axle 23 therein. A plurality of evenly spaced protrusions 44 extend upwardly from a top end of the outer wall 41. A plurality of evenly spaced bulwarks 45 corresponding to the protrusions 44 are circumferentially formed on the outer wall 41. Each of the bulwarks 45 extends along an axial direction of the bearing 40. The hole 42 includes an upper contact hole 422 providing an entrance of the pivot axle 23, a lower contact hole 426 providing an exit of the pivot axle 23 and a partition hole 424 located between the upper and lower contact holes 422, 426. The partition hole 424 intercommunicates with the upper and lower contact holes 422, 426. The upper contact hole 422 has the same diameter as the lower contact hole 426. The pivot axle 23 has a diameter which is substantially equal to the diameters of the upper and lower contact holes 422, 426 to engage in the upper and lower contact holes 422, 426. The partition hole 424 has a diameter larger than that of the upper and lower contact holes 422, 426, to thereby separate the pivot axle 23 from a corresponding inner surface of the bearing 40. The partition hole 424 extends along the axial direction and has a length which is substantially equal to that of the bulwarks 45 of the bearing 40. The length of the partition hole

424 along the axial direction is much longer than that of the upper and lower contact holes 422, 426.

Referring to FIG. 4, as the rotor assembly 20 with the bearing 40 is assembled on the fan base 10, the protrusions 44 of the bearing 40 abut against a bottom of the connecting portion 111 of the baffle element 110 of the central tube 11, and an inner surface (not labeled) of the circumferential wall (not labeled) of the central tube 11 abuts against the bulwarks 45. The central tube 11 exerts a radially inward pressure on the bearing 40 via the bulwarks 45. Since the bulwarks 45 are located corresponding to the partition hole 424 whose diameter is larger than that of the pivot axle 23, the radially inward pressure is not transferred to the pivot axle 23. Furthermore, since portions of the outer wall 41 of the bearing 40 corresponding to the upper and lower contact holes 422, 426 do not contact with the inner surface of the circumferential wall of the central tube 11, the radially inward pressure is not transferred to theses portions. Accordingly, the radially inward pressure exerted by the central tube 11 on the bearing 40 is not transferred to the pivot axle 23 via the bearing 40. Thus, the bearing 40 is so configured as to not only reduce the contact area between the pivot axle 23 and the bearing 40 but also prevent the radially inward pressure exerted by the central tube 11 on the bearing 40 from being exerted to the pivot axle 23 via the bearing 40, whereby a friction between the bearing 40 and the pivot axle 23 is reduced and the lifespan of the fan is prolonged accordingly. Moreover, the noise generated during operation of the fan is lowered.

Referring to FIGS. 5-8, in a second embodiment of the fan, the fan comprises a fan base, a rotor assembly, a stator assembly and a bearing 40*a*. The fan base, the rotor assembly and the stator assembly in this second embodiment have the same configuration as in the previous preferred embodiment. The bearing 40*a* has a cylindrical shape, and has a circumferential outer wall 41*a*. A central hole 42*a* is defined in a central portion of the bearing 40*a* for receiving the pivot axle 23 therein. The central hole 42*a* has a uniform diameter which is substantially equal to that of the pivot axle 23. A plurality of evenly spaced partition holes 43*a* communicating with the lubricant reservoir 14 are defined through the bearing 40*a* and circumferentially around the central hole 42*a*. The partition holes 43*a* are separated from the central hole 42*a*. A plurality of evenly spaced protrusions 44*a* corresponding to the partition holes 43*a* extend upwardly from a top end of the outer wall 41*a* and surround the partition holes 43*a*. A plurality of evenly spaced bulwarks 45*a* corresponding to the partition holes 43*a* are circumferentially formed on the outer wall 41*a*. A length of the bulwarks 45*a* along the axial direction is no longer than that of the partition holes 43*a*. Each of the partition holes 43*a* can have a uniform width. Alternatively, it can have a wedge-shaped cross section with a width increasing gradually from a top end to a bottom end thereof. The partition holes 43*a* can channel the lubricant oil flowing upwardly from a gag between the hole 42*a* and the pivot axle 23 to flow downwards back to the lubricant reservoir 14. The bearing 40*a* defines the partition holes 43*a* and the bulwarks 45*a* corresponding to the partition holes 43*a*, which effectively prevents the radially inward pressure exerted by the central tube 11 on the bearing 40 from being exerted to the pivot axle 23 via the bearing 40*a*, whereby a friction between the bearing 40*a* and the pivot axle 23 is reduced and the lifespan of the fan is prolonged accordingly.

Figure 9:
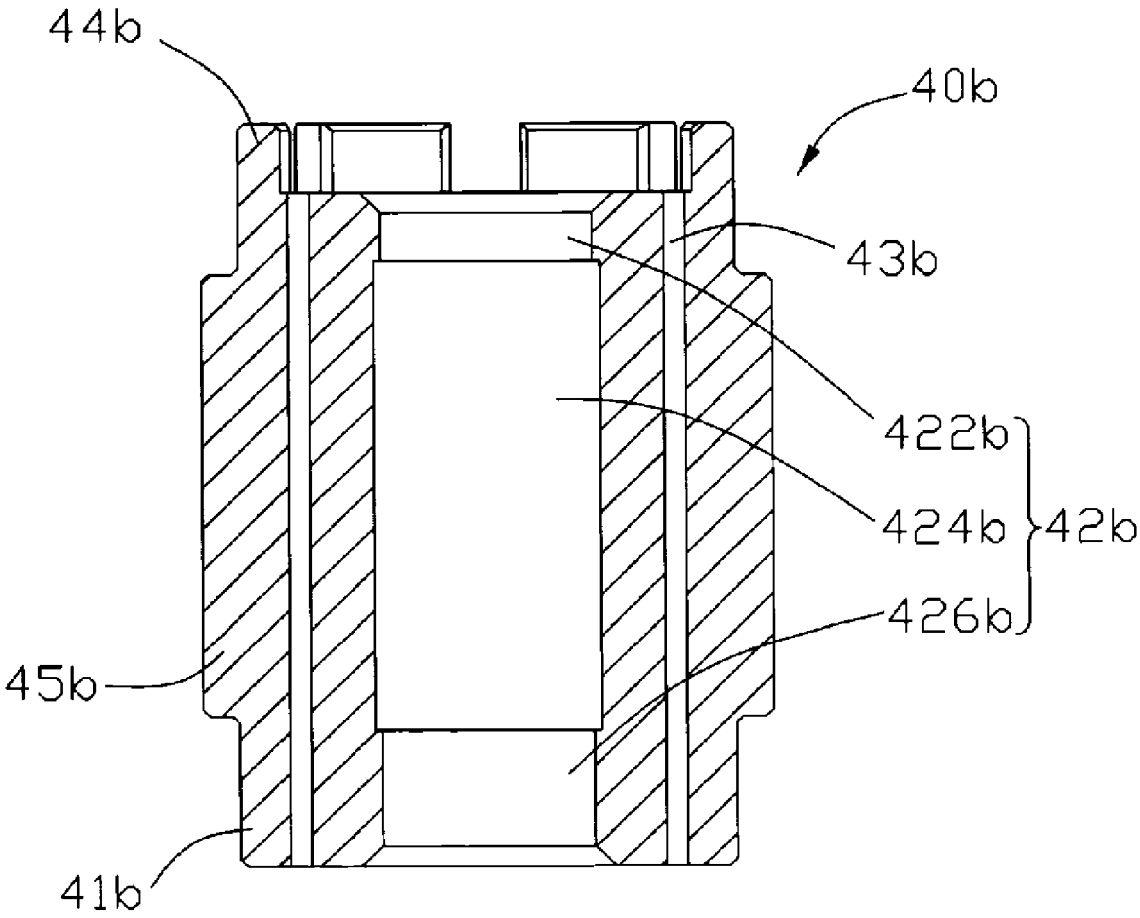
FIG. 9 is a cross-sectional view of a bearing in accordance with a third embodiment of the present invention.
Figure 10:
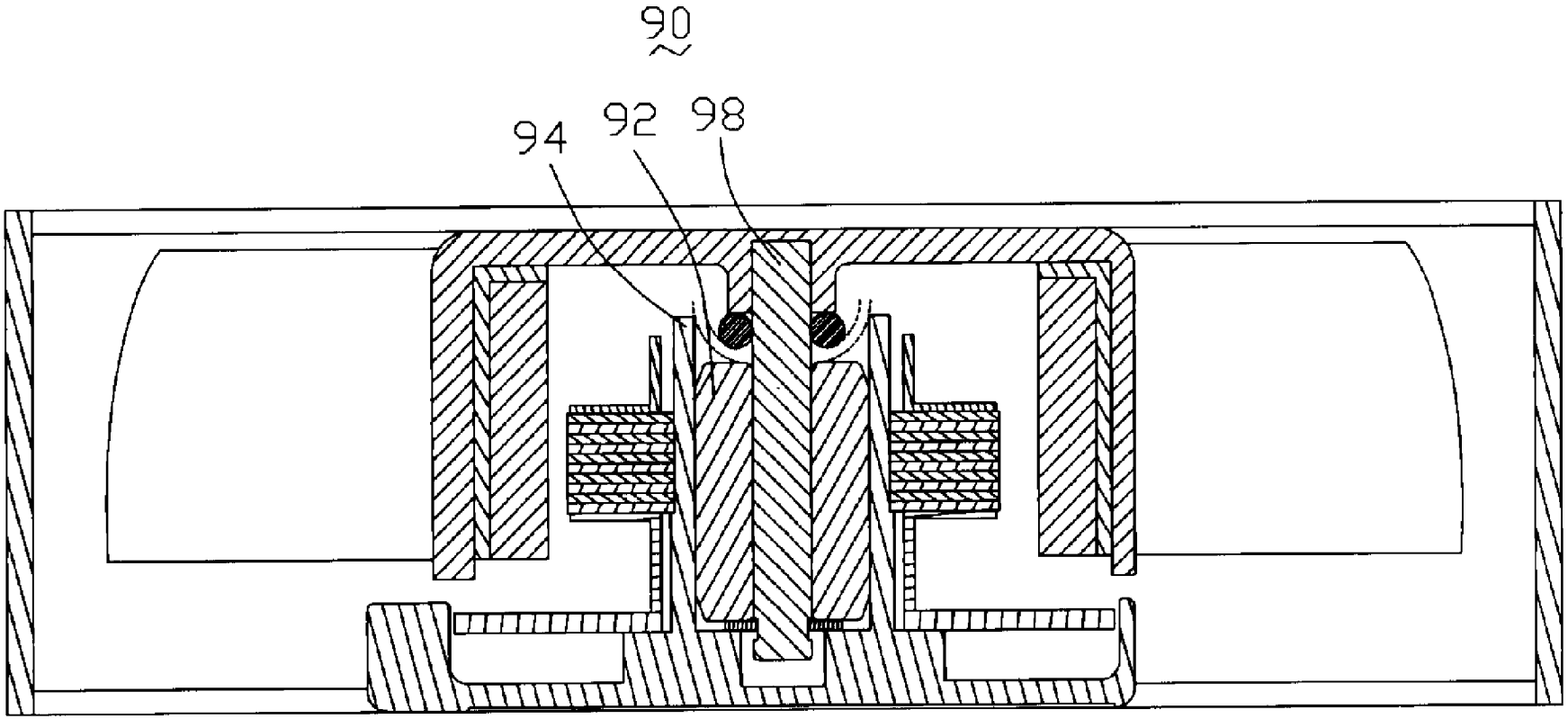
FIG. 10 (RELATED ART)
FIG. 10 is a cross-sectional view of an electric fan in accordance with related art.

FIG. 9 shows a bearing 40*b* in accordance with a third embodiment of the present invention. The bearing 40*b* is a combination of the features of the bearing 40 of the previous first embodiment and the bearing 40*a* of the previous second embodiment. The bearing 40*b* defines a central hole 42*b* and a plurality of evenly spaced slots 43*b* therein. The central hole 42*b* has the same configuration as the central hole 42 in the previous first embodiment and includes an upper contact hole 422*b*, a lower contact hole 426*b* and a partition hole 424*b* located between the upper and lower contact holes 422*b*, 426*b*. The partition hole 424*b* has a diameter larger than that of the upper and lower contact holes 422*b*, 426*b*, to thereby separate the pivot axle 23 from a corresponding inner surface of the bearing 40*b*. The slots 43*b* have the same configuration as the partition holes 43*a* in the previous second embodiment. The slots 43*b* communicating with the lubricant reservoir 14 are defined through the bearing 40*b* and circumferentially around the central hole 42*b*. The slots 43*b* are separated from the central hole 42*b*. A plurality of evenly spaced protrusions 44*b* corresponding to the slots 43*b* extend upwardly from a top end of an outer wall 41*b*. A plurality of evenly spaced bulwarks 45*b* corresponding to the slots 43*b* are circumferentially formed on the outer wall 41*b*. The bulwarks 45*b* are also located corresponding to the partition hole 424*b*. The design of the bearing 40*b* in accordance with the third preferred embodiment can more effectively prevent the friction between the bearing 40*b* and the pivot axle 23.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric fan comprising:

a fan base comprising a central tube;

a bearing received in the central tube, the bearing having an outer wall with at least one bulwark circumferentially formed thereon, the at least one bulwark abutting against an inner surface of the central tube, a central hole and at least one partition hole defined in the bearing, wherein the at least one partition hole corresponds to the at least one bulwark; and a rotor assembly comprising a fan hub, and a pivot axle joined to the fan hub and pivotably extending into the central hole of the bearing;

wherein the at least one partition hole corresponding to the at least one bulwark is so configured that it prevents a radially inward pressure exerted by the central tube on the bearing from being exerted to the pivot axle via the bearing, whereby a friction between the bearing and the pivot axle is reduced; and wherein the at least one partition hole is defined through the bearing and circumferentially around the central hole.

2. The electric fan of claim 1, wherein the at least one partition hole is separated from the central hole, and the central hole has a uniform diameter.

3. The electric fan of claim 1, wherein a baffle element bending from a top end of an outer wall of the central tube comprises a connecting portion extending perpendicularly and inwardly from the top end of the outer wall of the central tube and a leg extending downwardly from an inner end of the connecting portion, wherein a top of the bearing engages with a bottom of the connecting portion.

4. The electric fan of claim 3, wherein at least one protrusion corresponding to the at least one partition hole extends from the top of the outer wall of the bearing, and the at least one protrusion engages with the bottom of the connecting portion.

5. The electric fan of claim 1, wherein a lubricant reservoir is formed in the fan base below the bearing for reserving lubricant oil, the at least one partition hole communicating with the lubricant reservoir.

6. An electrical fan comprising:

a fan base having a central tube with an inner surface;

a bearing received in the central tube, the bearing having an outer wall with a plurality of evenly spaced bulwarks circumferentially formed thereon, the bulwarks engaging with the inner surface of the central tube, at least one partition hole defined in the bearing, wherein the at least one partition hole corresponds to the bulwarks; and a shaft rotatably received in the bearing;

wherein a radially inward pressure is exerted on the bulwarks of the bearing by the central tube, and the at least one partition hole corresponding to the bulwarks prevents the radially inward pressure from being exerted to the shaft via the bearing, whereby a friction between the bearing and the shaft is reduced; and wherein a plurality of evenly spaced protrusions extend upwardly from a top end of the outer wall of the bearing.

7. The electric fan of claim 6, wherein the bearing defines a central hole for receiving the shaft therein, the central hole includes the at least one partition hole having a diameter larger than that of the shaft for preventing the shaft from contacting with an inner surface of the bearing.

8. The electric fan of claim 6, wherein the bearing defines a central hole for receiving the shaft therein, the at least one partition hole is defined around the central hole and separated from the central hole.

9. The electric fan of claim 8, wherein the at least one partition hole has a wedge-shaped cross section for facilitating lubricant oil to flow towards a lubricant oil reservoir located at a bottom end of the bearing.

10. The electric fan of claim 6, wherein the central tube comprises a periphery wall and a baffle element bent inwardly from a top end of the periphery wall, and the baffle element engages with the protrusions of the bearing to prevent lubricant oil from leakage from a top of the bearing.

11. An electric fan comprising:

a fan base having a central tube;

a stator assembly mounted around the central tube;

a bearing received in the central tube;

a rotor pivotable respective to the stator assembly, having a pivot axle rotatably mounted in a hole of the bearing;

wherein the bearing has at least a bulwark protruding radially outwardly from a circumferential outer wall thereof, the at least a bulwark engaging with the central tube, and defines at least a void therein located between the at least a bulwark and the pivot axle, whereby a radially inward pressure exerted by the central tube on the at least a bulwark is prevented from being transferred to the pivot axle; and wherein the void is separate from the hole in which the pivot axle is mounted.

* * * * *

UNITED STATES PATENT AND TRADEMARK OFFICE

CERTIFICATE OF CORRECTION

PATENT NO. : 7,654,796 B2
APPLICATION NO. : 11/309368
DATED : February 2, 2010
INVENTOR(S) : Yeh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 755 days.

Signed and Sealed this

Twenty-eighth Day of December, 2010

David J. Kappos

David J. Kappos
*Director of the United States Patent and Trademark Office*